United States Patent [19]

Stuck

[11] Patent Number: 4,964,186

[45] Date of Patent: Oct. 23, 1990

[54] FLOOR MOP HEAD HAVING REMOVABLE SCUFF PAD

[75] Inventor: John E. Stuck, Independence, Mo.

[73] Assignee: United Floorcare Systems, Inc., Independence, Mo.

[21] Appl. No.: 360,078

[22] Filed: Jul. 18, 1989

[51] Int. Cl.[5] ..... A47L 13/12; A47L 13/20

[52] U.S. Cl. ..... 15/118; 15/229.2; 15/246

[58] Field of Search ..... 15/118, 105, 111, 119 R, 15/229.1, 229.2, 229.5, 229.6, 229.9, 246, 226; 300/16, 21

[56] References Cited

U.S. PATENT DOCUMENTS

| | | | |
|---|---|---|---|
| 3,432,873 | 3/1969 | Moss | 15/118 |
| 3,750,218 | 8/1973 | Rosocha | 15/118 |
| 3,795,934 | 3/1974 | Moss | 15/118 |
| 4,675,932 | 6/1987 | Hofacker, Jr. | 15/118 |

*Primary Examiner*—Edward L. Roberts

*Attorney, Agent, or Firm*—Hovey, Williams, Timmons & Collins

[57] ABSTRACT

A mop head for use with a cleaning pad formed of a fibrous material, includes a plurality of lengths of string material and a band extending generally transverse to and bisecting the lengths of string material. At least one strip of pad fastening material having a plurality of resilient hooks formed therein is provided on the mop head for retaining a cleaning pad, of varying size of type, if desired, on the mop head. The hooks on the strip of pad retaining material are adapted to engage the fibrous material of the cleaning pad so as to retain the cleaning pad on the mop head adjacent the band. Thus, the cleaning pad is held to the mop head at a position in which the pad may be pressed against a floor surface by the mop handle so that sufficient pressure may be easily applied to the pad during a cleaning operation. The pad is removable for cleaning or replacement thereof. A method of constructing the mop head is also disclosed.

23 Claims, 3 Drawing Sheets

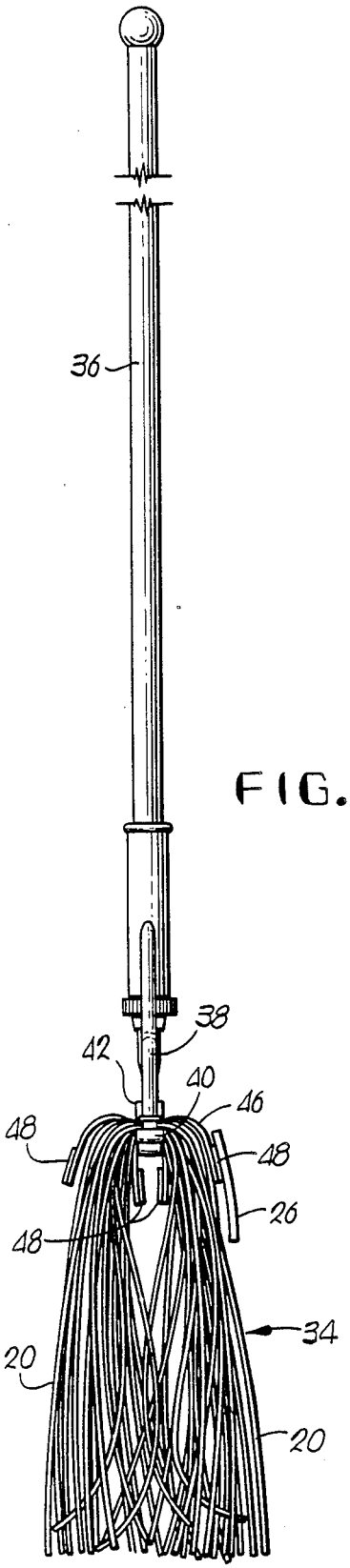
FIG. 4.
FIG. 5.
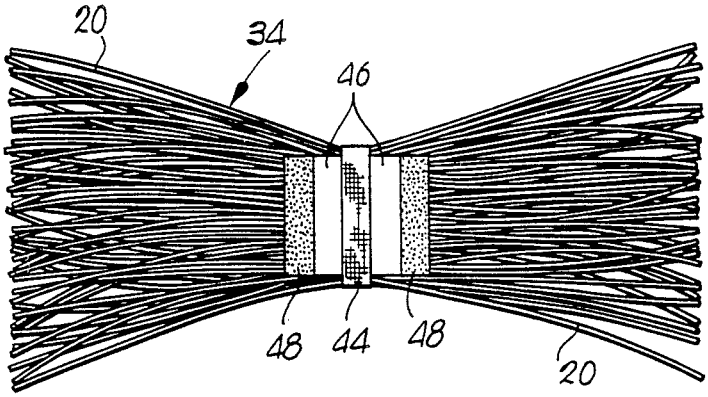
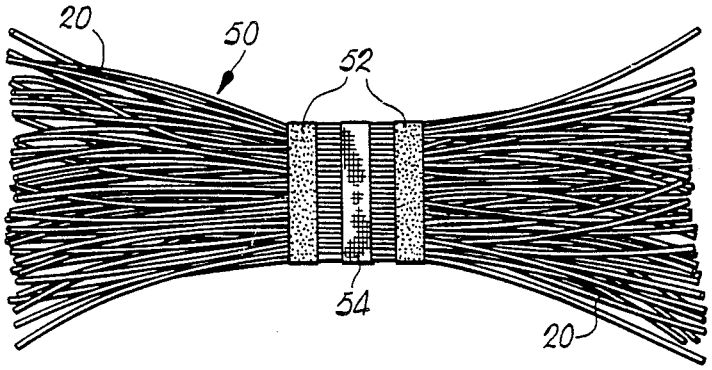
FIG. 6.

FLOOR MOP HEAD HAVING REMOVABLE SCUFF PAD

BACKGROUND OF THE INVENTION

1. Field of the Invention

The present invention relates generally to mop heads and, more particularly, to a mop head construction including means for fastening a removable scuff pad on the mop head.

2. Discussion of the Prior Art

The use of string mops in floor care is well known. These mops are typically used either in cleaning the floor of loose materials, stains and dirt prior to polishing of the floor, or in stripping and rinsing a floor finish prior to application of a new finish.

If a stain, scuff mark, or spot of finish residue is encountered during a cleaning or stripping operation, it is also known to employ a string mop to remove the stain, etc., by pressing downward on the handle of the mop to exert a force on the strings and band of the mop head located adjacent the handle. By exerting this force on the mop head and moving the mop back and forth in a scrubbing motion, the stain may sometimes be removed.

One attempt which has been made to improve the utility of this known type of string mop includes the use of an abrasive pad which is generally rectangular in shape and sewn or stitched transversely to one side of the mop assembly under the band along one edge margin of the pad at a midpoint of the mop assembly. In this construction, because the abrasive pad is sewn or stitched to the band of the mop head, it is not easily replaced upon wearing out. Thus, when the pad becomes worn out, this improvement of the conventional string mop is rendered useless. In addition, once a pad has been fastened to the mop assembly, it cannot be replaced with a pad having different characteristics for use in carrying out different types of cleaning operations. For a disclosure of this known type of mop assembly, see U.S. Pat. No. 4,675,932, at column 1, lines 24–45.

Another known mop assembly is also disclosed in U.S. Pat. No. 4,675,932, and is the subject of that patent. In this known assembly, a layer of abrasive material and a layer of backing material are employed in the central band of a mop head, and an end of the abrasive material is looped back onto itself and sewn thereto to form a transverse loop portion outwardly disposed from the bundle. Thus, as with the previously discussed known device, the abrasive material is sewn or stitched to the assembly in such a way as to form a permanent irreplaceable part of the assembly which can be neither removed nor replaced during the life of the mop assembly.

OBJECTS AND SUMMARY OF THE INVENTION

It is an object of the present invention to provide a mop head having means for fastening a removable cleaning pad thereon at a position adjacent to a mop handle so that the pad may be pressed against a floor to remove unwanted material from the floor merely by exerting pressure on the handle.

It is a further object of the invention to provide a mop head in which a cleaning pad may be easily removed in a one-step procedure to permit either cleaning or replacement of the mop or pad.

Additionally, it is an object of the invention to provide a mop head that may be used with any available cleaning or stripping pad which will stay attached to the retaining means. It is possible, through the use of the present invention to employ a cleaning or stripping pad of any desired size or shape without requiring any modification or re-assembly of the mop head or handle.

In accordance with the invention, a mop head for use with a cleaning pad formed of fibrous material includes a plurality of lengths of string material and a band extending generally transverse to and bisecting the lengths of string material. At least one strip of pad fastening material having a plurality of resilient hooks formed therein is provided on the mop head for fastening the cleaning pad on the mop head. The hooks on the strip of pad fastening material are adapted to engage the fibrous material of the cleaning pad so as to fasten and retain the cleaning pad on the mop head adjacent the band. Thus, the cleaning pad is held to the mop head at a position in which the pad may be pressed against a floor surface by the mop handle so that sufficient pressure may be easily applied to the pad during a cleaning operation. Further, merely by providing the pad on the mop head during normal mop cleaning, the pad provides some additional cleaning of the floor.

A cleaning pad for use in combination with the inventive mop head preferably is made of a material which sticks or is retained on the hooked material provided on the mop head. Depending upon the use to which the pad is to be put, it may be constructed of material which is useful, e.g. in removing scuff marks and black marks from a floor during cleaning, or in stripping a residue of floor finish from a floor.

BRIEF DESCRIPTION OF THE DRAWING FIGURES

A preferred embodiment of the invention is described in detail below with reference to the attached drawing figures, wherein:

FIG. 4 is a side elevational view of a narrow-band mop head including a stirrup-type handle constructed in accordance with a second embodiment of the invention;

FIG. 5 is a plan view of a narrow-band mop head constructed in accordance with the embodiment shown in FIG. 4;

FIG. 6 is a plan view of a third embodiment of the invention; and

DETAILED DESCRIPTION OF THE PREFERRED EMBODIMENT

Figure 1:
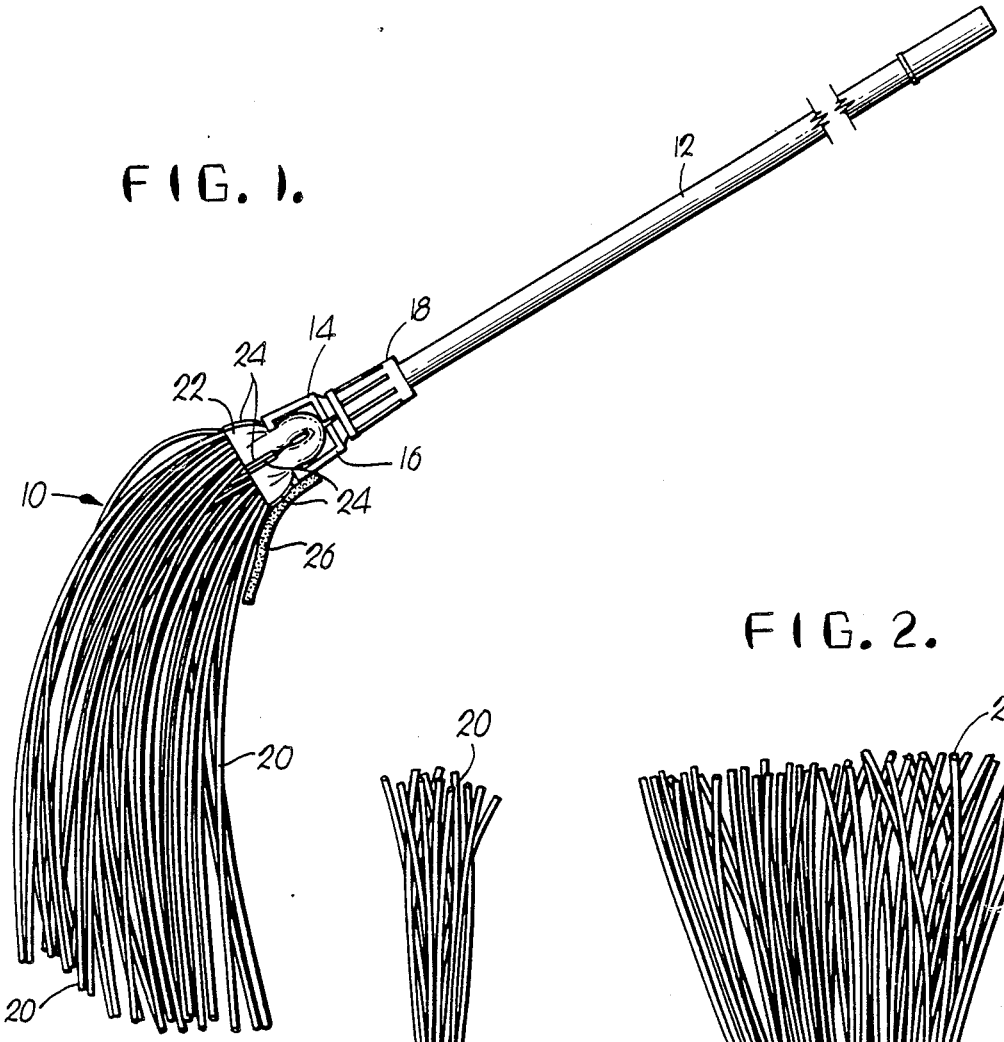
FIG. 1 is a side elevational view of a wide-band mop head including a grip-type handle constructed in accordance with a first embodiment of the invention.
Figure 2:
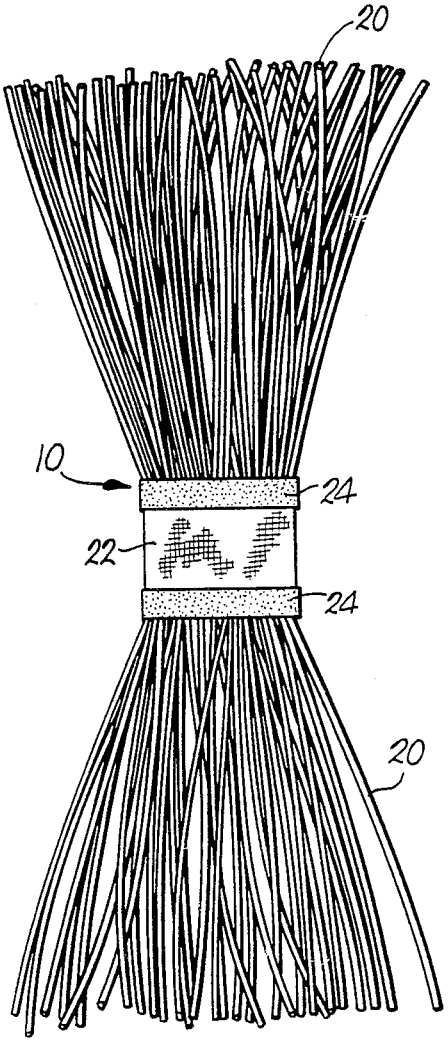
FIG. 2 is a plan view of a wide-band mop head constructed in accordance with the embodiment shown in FIG. 1.

A first embodiment of a mop head constructed in accordance with the present invention is illustrated in FIGS. 1 and 2.

As shown in FIG. 1, the wide-band mop head 10 is provided in a grip-type mop handle 12, having a pair of opposed mop head support jaws 14, 16 pivotally supported at one end of the handle 12, and a threaded collar 18 axially movable along the handle between a first position clamping the jaws 14, 16 toward one another and a second position in which the jaws are permitted to move apart from one another. Although not shown in the drawing, the jaws 14, 16 include a threaded section beneath the collar 18 which is engaged by the threads of the collar and on which the collar is retained in any desired position thereof.

The wide-band mop head 10 is shown in detail in FIG. 2, and includes a plurality of lengths of string 20 bunched and held together at a central location by a binding means comprising a central band 22. The strings 20 may be formed of rayon, a cotton blend or any other conventional synthetic blend, and the band 22 is made of any material having sufficient strength to hold the strings together during extended use of the mop. The band 22 has a width in the direction of the length of the strings which is large enough to permit the mop head to be folded over on itself and clamped in the jaws 14, 16, as shown in FIG. 1, while leaving a small region of the band 22 exposed beyond the jaws. Canvas and nylon are common materials that may be employed in the band material, but it is understood that the material making up the band is not a significant feature of the present invention, and that any material providing the requisite binding strength will suffice. Further, the use of other known binding means is possible.

As can also be seen from FIG. 1, four strips 24 of cleaning pad fastening material are sewn or otherwise attached to the band 22 along each of the four edges of the band. The pad fastening material includes a large number of closely spaced hooking elements extending from one surface thereof, and may be of the type disclosed in U.S. Pat. No. 3,099,235, to G. deMestral, which is presently marketed under the trademark "VELCRO". This type of material has been found to provide sufficient retention of certain types of cleaning pads on the mop head without the need for providing any special cooperative attachment materials on the cleaning pad itself.

Although four strips 24 are provided in the illustrated embodiment, it is understood that the mop head of the preferred embodiment would be operable if only one strip was provided. Thus, any number of strips of pad retaining material may be attached to the band without departing from the scope of the invention.

The cleaning pad 26 is preferably formed of fibers which are blown together, injected with a binder and any desired abrasive, and baked. By providing a cleaning pad 26 formed by this or a similar process, the pad is provided with a large number of randomly oriented fibers which are sized properly to be fastened and retained on the pad fastening material, and it is not necessary to provide a strip or patch of special looped materials on the pad in order for the pad to stick to the fastening material.

Although the construction of the pad 26 does not make up a part of the present invention, other than that it include some type of fibrous material for engaging the hooks of the fastening material, it is understood that numerous types of cleaning pads may be used with any one mop constructed in accordance with the preferred embodiment. For example, pads are presently available which provide an advantageous cleaning of dirty scuff marks, black heel marks and the like without removing the existing finish on a floor, while other pads are useful in removing a residue of finish while stripping finish from a floor. By permitting this selection of cleaning pads to be possible, the utility of the mop head of the preembodiment is increased, and it is possible to employ the mop head in any of several different types of cleaning operations, simply by removing and replacing the cleaning pad with a different pad having the desired characteristics.

Because the pad 26 is formed of a fibrous composition, any desired size and shape of the pad may be used, and the pad may be positioned on the strip 24 of pad retaining material in any desired orientation which will serve the immediate cleaning need. For example, if a larger, thinner pad is needed for certain applications while a smaller, thicker pad is useful for others, it is possible to replace the unwanted pad with a desired pad merely by pulling off the presently retained pad from the mop head and pressing the desired pad into place on the strip 24. Thus, the replacement operation is a one-step procedure which can be accomplished without removing the mop head from the handle 12 and without having to finger the mop head 10.

Figure 3:
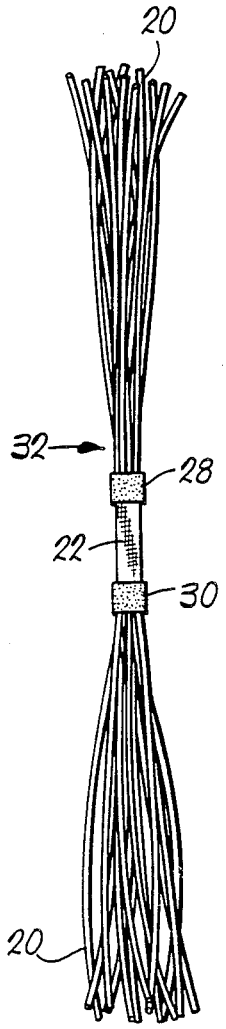
FIG. 3 is a side view of a wide-band mop head constructed in accordance with the embodiment of FIG. 1, with the exception that an alternate construction of the hook material strips on the mop head is illustrated.

Turning to FIG. 3, an alternate construction is illustrated which is identical to the mop head shown in FIG. 2, except that the strips of pad fastening material are formed by a pair of webs 28, 30 of the material which extend around substantially the entire circumference of the edges of the band 22. By constructing the mop head 32 in accordance with this embodiment, the area along which the pad 26 may be fastened on the mop head is increased to include the regions of the mop head adjacent the sides thereof.

A further embodiment of the present invention is shown in FIGS. 4 and 5 which is designed for use with a mop handle that differs from the grip-type handle 12 discussed above. As shown in FIG. 4, a narrow-band mop head 34 constructed in accordance with this further embodiment may be employed on a string mop including a stirrup-type handle 36 having a generally U-shaped pair of legs 38 extending axially from the lower end thereof, and a lower cross bar 40 engageable with the lower ends of the legs 38 and movable out of engagement with at least one of the legs to an open position. When the cross bar 40 is in this open position, the narrow-band mop head 34 may be placed between the legs 38 with the central region of the mop head resting on the lower cross bar 40. Thereafter, the cross bar may be swung back into engagement with the legs and an upper cross bar 42 lowered into pressing contact with the mop head so as to squeeze the mop head between the two cross bars and retain the mop head on the handle.

As can be seen from FIG. 5, the narrowband mop head 34 is similar to the mop heads 10, 32 of FIGS. 1–3, in that it includes a plurality of lengths of string 20 bunched and held together at a central location by a central band. However, in this embodiment, the band 44 has a width in the direction of the length of the strings which is very narrow relative to the band 22 of FIGS. 1–3, and is only wide enough to permit the mop head 34 to be held and clamped between the cross bars 40, 42. Thus, little if any of the band 44 is exposed beyond the cross bars.

In order to provide support on the mop head 34 for pad fastening material of the type discussed above, at least one flap or skirt 46 of canvas or like material is stitched along one edge thereof to an edge of the band 44, such that the flap 46 extends outward of the band 44 toward an end of the mop head 34. A strip 48 of pad fastening material is sewn or otherwise attached to this flap 46 with the large number of closely spaced hooking elements extending from the outward exposed surface thereof so as to present the hooking elements to a cleaning pad being pressed thereagainst. In the mop head illustrated in FIG. 5, four of the flaps 46 are provided in order to permit a pad 26 to be fastened on the mop in any possible orientation of the mop head relative to the handle. Alternatively, a skirt could be provided in place of the flaps, the skirt extending along substantially the entire edge of the band, or with the skirt being constructed of material of sufficient strength to serve as the banding material itself.

In FIG. 6, another variation of the preferred embodiment is illustrated. In this construction, the pad fastening material is not provided on the central band or on a flap or skirt connected to the band, but rather is included on a mop head 50 as a separate band or bands 52 extending transversely of and encircling the bunched lengths of string 20. Preferably, a separate band 52 of pad fastening material is provided on each side of the central band 54, and these bands are sewn or fastened to the strings of the mop head 50 while the strings 20 are spread apart by a slight amount so that the bands will act to maintain the strings spread apart during use. It has been found that in order for the band 52 to retain the pad in a position where it may be pressed against the floor with sufficient force to remove scuff marks on the floor, the band 52 should be located at a position on the strings just above where the strings normally contact the floor during a mopping operation. This position is typically less than four inches from the midpoint of the mop, and is chosen to permit the pad to be fastened to the mop head in such an orientation as to be pressed into engagement with the hook material when increased pressure is exerted on the handle during use.

By this construction, the bands serve a dual role as both pad retaining means and spreading means. Further, although the mop head shown in FIG. 6 illustrates the use of the bands of fastening material in connection with a central band of narrow width, it is understood that this construction of the pad fastening material could also be used in a mop head having a wide band.

Figure 7:
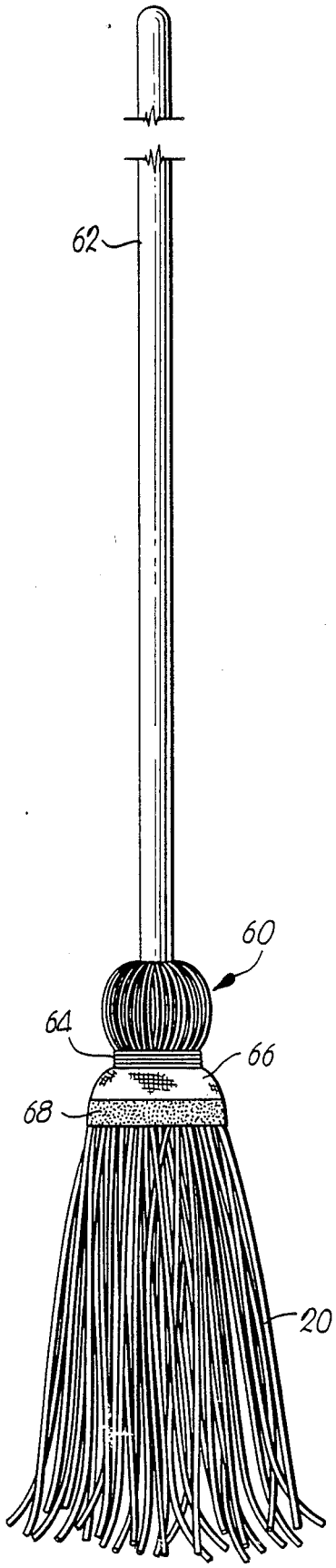
FIG. 7 is a side elevational view of a mop including a mop head constructed in accordance with a further embodiment of the invention.

Another embodiment of the invention is illustrated in FIG. 7, and includes a mop head 60 fastened to a handle 62 by a plurality of wraps of wire or other banding material 64. A skirt 66 of canvas or the like is held on the mop head 60 by the banding material 64, such that the skirt fits down over at least a portion of the strings 20.

A strip of pad fastening material 68 is sewn or otherwise attached to this skirt 66 with the hooking elements extending from the outward exposed surface thereof. A pad of the type described above may thereafter be fastened on the mop head simply by pressing the pad against the pad fastening material.

To construct a mop head of the type shown in the drawings and discussed above, conventional assembly techniques are followed except that an additional step is included of attaching the pad retaining material to the mop head. Preferably, the strip or web of pad fastening material is either sewn onto the central band after the band is attached to the lengths of string, or is sewn to a flap or skirt which is attached to the string lengths. Alternatively, in the embodiment of FIG. 6, the pad fastening material is substituted for materials conventionally used as spreading bands such that no additional assembly steps are required as compared to known methods of constructing mop heads having bands for spreading the string lengths apart.

Although the invention has been described with reference to the preferred embodiment, it is noted that substitutions may be made and equivalents employed herein without departing from the scope of the present invention as recited in the claims. For example, buttons or snaps could be used to retain a pad on the mop head in addition to the pad fastening material of the preferred embodiment. Such use of buttons or snaps either in addition to or in place of the fastening material is not as advantageous as the preferred embodiment since such expedients require modification of both a mop head and a pad in order to permit cooperation therebetween.

What is claimed is:

1. A mop head for use with a cleaning pad formed at least partially of fibrous material, the mop head comprising:

a plurality of lengths of string material;

banding means for fastening the plurality of lengths of string material together; and at least one strip of pad fastening material having a plurality of resilient hooks formed therein adapted to engage the fibrous material of the cleaning pad so as to fasten the cleaning pad on the mop head.

2. The mop head as set forth in claim 1, wherein the at least one strip of pad fastening material is attached directly to the banding means.

3. The mop head as set forth in claim 1, wherein the at least one strip of pad fastening material is attached directly to at least some of the plurality of lengths of string material.

4. The mop head as set forth in claim 3, wherein the at least one strip of pad fastening material is attached to the string material at a distance of less than four inches from the midpoint of the mop.

5. The mop head as set forth in claim 3, wherein the at least one strip of pad fastening material extends transversely of and encircles the lengths of string material, the strip being attached to the lengths of string material to form first and second opposed strip lengths.

6. The mop head as set forth in claim 5 wherein two strips of pad fastening material are attached to the lengths of string material, one of the strips being disposed opposite of the other strip relative to the banding means.

7. The mop head as set forth in claim 1, further comprising at least one flap having an edge which is attached directly to the banding means, the at least one strip of pad fastening material being attached directly to the at least one flap.

8. The mop head as set forth in claim 1, wherein the banding means includes a band having first and second opposed band lengths, a strip of pad fastening material being provided on each of the band lengths.

9. The mop head as set forth in claim 8 wherein two strips of pad fastening material are disposed on each of the band lengths.

10. The mop head as set forth in claim 9 wherein the four strips of pad fastening material are formed of two webs of strip fastening material each of which extends along both of the first and second opposed band lengths.

11. The mop head as set forth in claim 8 wherein the strips of pad fastening material are formed of a single web of strip fastening material that extends along both of the first and second opposed band lengths.

12. A combination mop head and cleaning pad comprising:

a cleaning pad formed of fibrous material;

a plurality of lengths of string material;

a band extending generally transverse to and bisecting the lengths of string material and fastening the string material together at least one strip of pad fastening material having a plurality of resilient hooks formed therein, the hooks being sized to engage the fibrous material of the cleaning pad so as to fasten the cleaning pad on the mop head adjacent the band.

13. The mop head as set forth in claim 12, wherein the at least one strip of pad fastening material is attached directly to the band.

14. The mop head as set forth in claim 12, wherein the at least one strip of pad fastening material is attached directly to at least some of the plurality of lengths of string material.

15. The mop head as set forth in claim 14, wherein the at least one strip of pad fastening material is attached to the string material at a distance of less than four inches from the midpoint of the mop.

16. The mop head as set forth in claim 14, wherein the at least one strip of pad fastening material extends transversely of and encircles the lengths of string material, the strip being attached to the lengths of string material to form first and second opposed strip lengths.

17. The mop head as set forth in claim 16, wherein two strips of pad fastening material are attached to the lengths of string material, one of the strips being disposed opposite of the other strip relative to the band.

18. The mop head as set forth in claim 12, further comprising at least one flap having an edge which is attached directly to the band, the at least one strip of pad fastening material being attached directly to the at least one flap.

19. The mop head as set forth in claim 12, wherein the band includes first and second opposed band lengths, a strip of pad fastening material being provided on each of the band lengths.

20. The mop head as set forth in claim 19, wherein two strips of pad fastening material are disposed on each of the band lengths.

21. The mop head as set forth in claim 19 wherein the strips of pad fastening material are formed of a single web of strip fastening material that extends along both of the first and second opposed band lengths.

22. The mop head as set forth in claim 20, wherein the four strips of pad fastening material are formed of two webs of strip fastening material each of which extends along both of the first and second opposed band lengths.

23. A method of constructing a mop head for use with a cleaning pad formed of a fibrous material, the method comprising the steps of:

aligning a plurality of lengths of string material;

binding the lengths of string material together with a band to form a unitary mop head; and attaching at least one strip of pad fastening material to the mop head, the strip of fastening material having a plurality of resilient hooks formed therein adapted to engage the fibrous material of the cleaning pad so as to retain the cleaning pad on the mop head adjacent the band.

* * * * *